US011613031B2

(12) United States Patent
Wonderley

(10) Patent No.: US 11,613,031 B2
(45) Date of Patent: Mar. 28, 2023

(54) UTILITY KNIFE

(71) Applicant: AccuTec Blades, Inc., Verona, VA (US)

(72) Inventor: Jeffrey W. Wonderley, Fort Defiance, VA (US)

(73) Assignee: ACCUTEC, INC., Verona, VA (US)

( * ) Notice: Subject to any disclaimer, the term of this patent is extended or adjusted under 35 U.S.C. 154(b) by 65 days.

(21) Appl. No.: 16/600,406

(22) Filed: Oct. 11, 2019

(65) Prior Publication Data

US 2020/0114531 A1 Apr. 16, 2020

Related U.S. Application Data

(60) Provisional application No. 62/881,859, filed on Aug. 1, 2019, provisional application No. 62/744,573, filed on Oct. 11, 2018.

(51) Int. Cl.
*B26B 5/00* (2006.01)
*B25G 1/08* (2006.01)

(52) U.S. Cl.
CPC . *B26B 5/00* (2013.01); *B25G 1/08* (2013.01)

(58) Field of Classification Search
CPC ..... B26B 5/00; B26B 1/02; B25G 1/08
USPC ..... 30/342, 339, 340
See application file for complete search history.

(56) References Cited

U.S. PATENT DOCUMENTS 2,743,523 A * 5/1956 Honey ..... B26B 27/005 30/286
3,085,330 A * 4/1963 Lewinski ..... B26B 5/00 30/293
3,906,625 A * 9/1975 Gringer ..... B26B 5/005 30/125
4,261,104 A * 4/1981 Cuscovitch ..... B25G 3/00 30/330
5,303,469 A 4/1994 Yin-Han
5,794,350 A 8/1998 Shand
(Continued)

FOREIGN PATENT DOCUMENTS

DE 102008024096 A1 * 11/2009 ..... B26B 29/02
KR 20-0382073 Y1 4/2005

OTHER PUBLICATIONS

International Search Report and Written Opinion dated Dec. 13, 2019, in related International Patent Application No. PCT/2019/056002.

(Continued)

*Primary Examiner* — Evan H Macfarlane
*Assistant Examiner* — Liang Dong
(74) *Attorney, Agent, or Firm* — Budzyn IP Law, LLC

(57) ABSTRACT

A utility knife includes a body having a handle portion and a head portion, the handle portion having a plurality of recesses formed in the handle portion. Each of the recesses is capable of receiving at least one replacement blade. A grip is pivotally attached to the handle portion and configured to be positioned in an open position or a closed position, the grip in the open position providing access to the at least one replacement blade. A blade carrier is pivotally coupled to the body, the blade carrier having a post and being rotatable between a closed position and an open position. An active blade is received by the post of the blade carrier such that the post extends into an opening of the active blade.

13 Claims, 10 Drawing Sheets

(56) References Cited

U.S. PATENT DOCUMENTS

| | | | | |
|---|---|---|---|---|
| 6,026,575 | A * | 2/2000 | Wonderley | B26B 5/00 30/125 |
| 8,572,850 | B2 | 11/2013 | Wu | |
| 9,259,845 | B2 * | 2/2016 | Gringer | B26B 5/003 |
| 2003/0037444 | A1 | 2/2003 | Chunn | |
| 2003/0140504 | A1 * | 7/2003 | Shannon | B26B 29/06 30/294 |
| 2007/0050988 | A1 | 3/2007 | Di Bitonto et al. | |
| 2008/0066318 | A1 * | 3/2008 | Ye | B26B 1/042 30/155 |
| 2009/0151168 | A1 | 6/2009 | Dadam | |
| 2012/0180325 | A1 | 7/2012 | Wu et al. | |
| 2014/0109414 | A1 | 4/2014 | Lau | |
| 2015/0360374 | A1 | 12/2015 | Gringer et al. | |

OTHER PUBLICATIONS

Search Report from European Patent Application No. 19871736.5, dated Jun. 3, 2022.

Extended European Search Report for European Application No. 19871736.5 dated Sep. 14, 2022.

* cited by examiner

UTILITY KNIFE

CROSS-REFERENCES TO RELATED APPLICATIONS

This application claims the benefit of and priority to U.S. Patent Application No. 62/744,573, filed Oct. 11, 2018, and U.S. Patent Application No. 62/881,859, filed Aug. 1, 2019, both of which are hereby incorporated by reference.

BACKGROUND

The present disclosure relates generally to utility knives. Utility knives are used for a variety of tasks, including cutting materials for construction, industrial, household, recreational and other uses. Materials cut by utility knives vary, but may include plastic, wood, metal, paper, and other materials. Utility knives are sometimes used for specific purposes and may include special features related to those purposes. Examples may include knives used for construction materials such as carpet or tile. In most cases, it is desired that a knife includes a sharp cutting instrument such as a knife blade. Some knives may have fixed blades that can be re-sharpened after repeated use. Other knives may employ disposable blades that are replaced when the blade becomes dull or damaged.

SUMMARY

In one embodiment, a utility knife includes a body having a handle portion and a head portion. The handle portion includes a recess capable of receiving at least one replacement blade. A blade carrier is pivotally coupled to the blade body and rotatable between an open position and a closed position.

In another embodiment, a utility knife includes a body having a handle portion and a head portion, the handle portion having a plurality of recesses formed in the handle portion. Each of the recesses is capable of receiving at least one replacement blade. A grip is pivotally attached to the handle portion and configured to be positioned in an open position or a closed position. The grip in the open position provides access to the at least one replacement blade. A blade carrier is pivotally coupled to the blade body. The blade carrier has a post and is rotatable between a closed position and an open position. In the closed position, the blade carrier is received by the head portion of the body, and in the open position, the blade carrier has been rotated away from the head portion of the body. An active blade is received by the post of the blade carrier such that the post extends into an opening of the active blade. The active blade is positioned in at least one of a cutting position and a scoring position.

In still another embodiment, a method of replacing a blade in a utility knife is provided. The method comprises unlocking a blade carrier and rotating the blade carrier from a closed position to an open position. An active blade is removed from the blade carrier, and a replacement blade is placed in the blade carrier. The blade carrier is returned to the closed position, and the blade carrier is locked.

Other objects, features, and advantages of the illustrative embodiments will become apparent with reference to the drawings, detailed description, and claims that follow.

DETAILED DESCRIPTION

In the following detailed description of several illustrative embodiments, reference is made to the accompanying drawings that form a part hereof, and in which is shown by way of illustration specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The present disclosure relates to a utility knife that may include a position-adjustable blade. The utility knife may be used for a variety of purposes, but the utility knife is particularly useful when used for construction tasks. In certain embodiments, it is desired that the knife be used to cut or score tile, such as vinyl tile, that may be installed on the floor of a residential or commercial building. The utility knife described herein may include a variety of features that promote ease of use during cutting and scoring operations, but that also make replacement of blades a simple and quick process when an active blade becomes dull or damaged. The utility knife further includes a number of features that promote safety and lessen the risk of injury to a user of the utility knife. The accompanying drawings and the description contained herein provide examples of various embodiments of the utility knife, blade and other components of the present disclosure.

Figure 1:
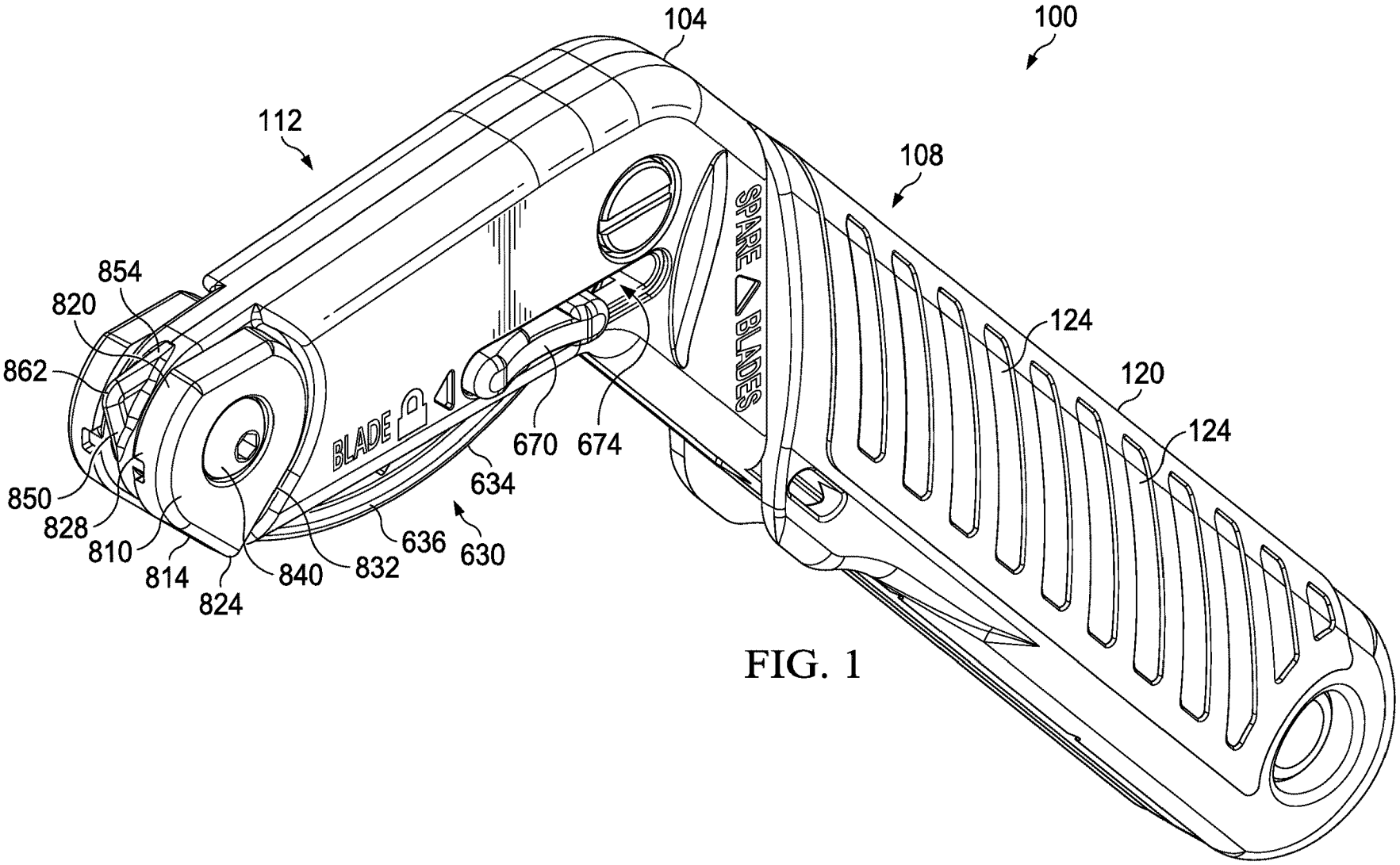
FIG. 1 illustrates an isometric right side and top view of a utility knife according to an illustrative embodiment, the utility knife having a grip in a closed position.
Figure 2:
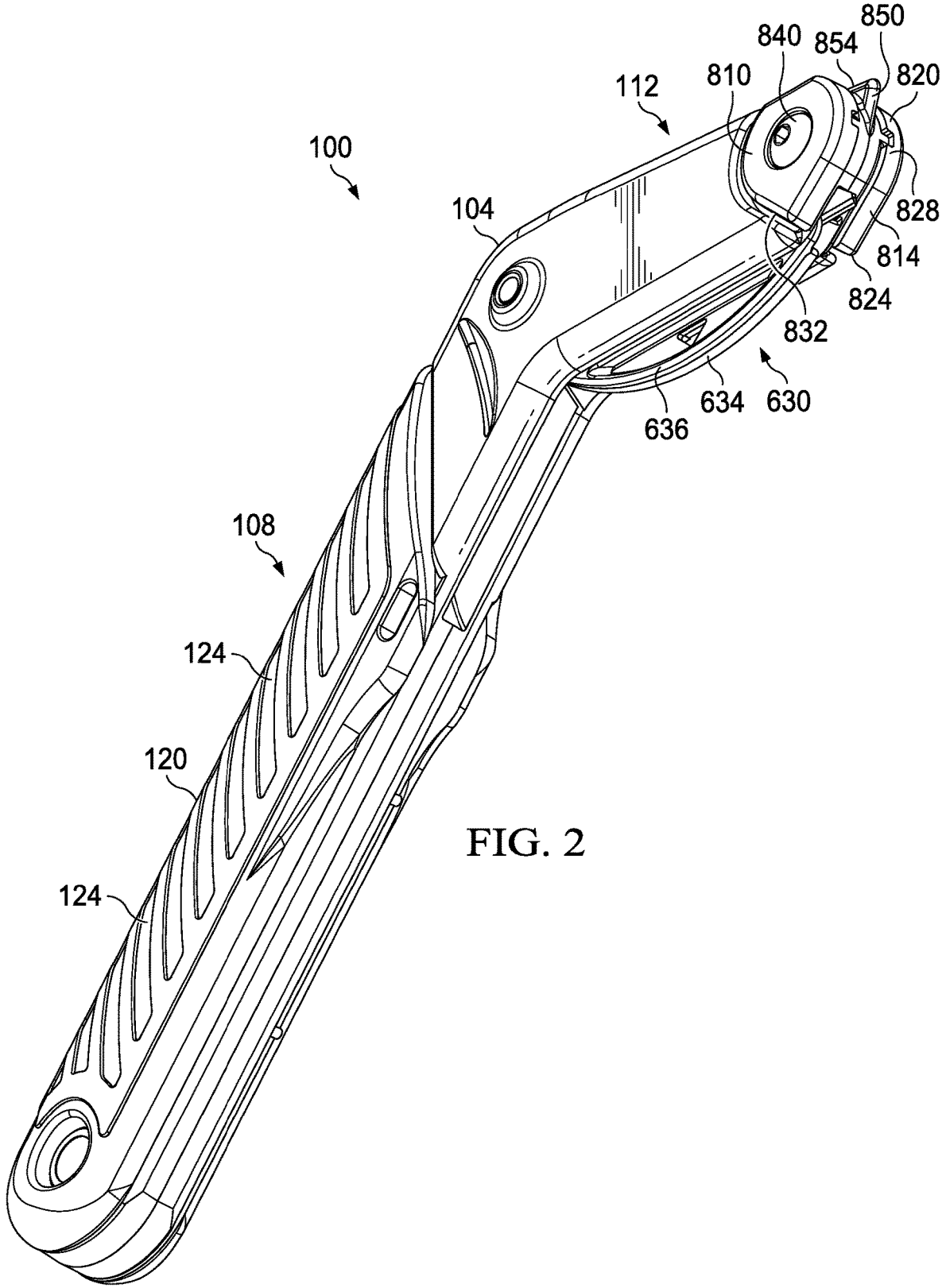
FIG. 2 illustrates an isometric left side and bottom view of the utility knife of FIG. 1.
Figure 5A:
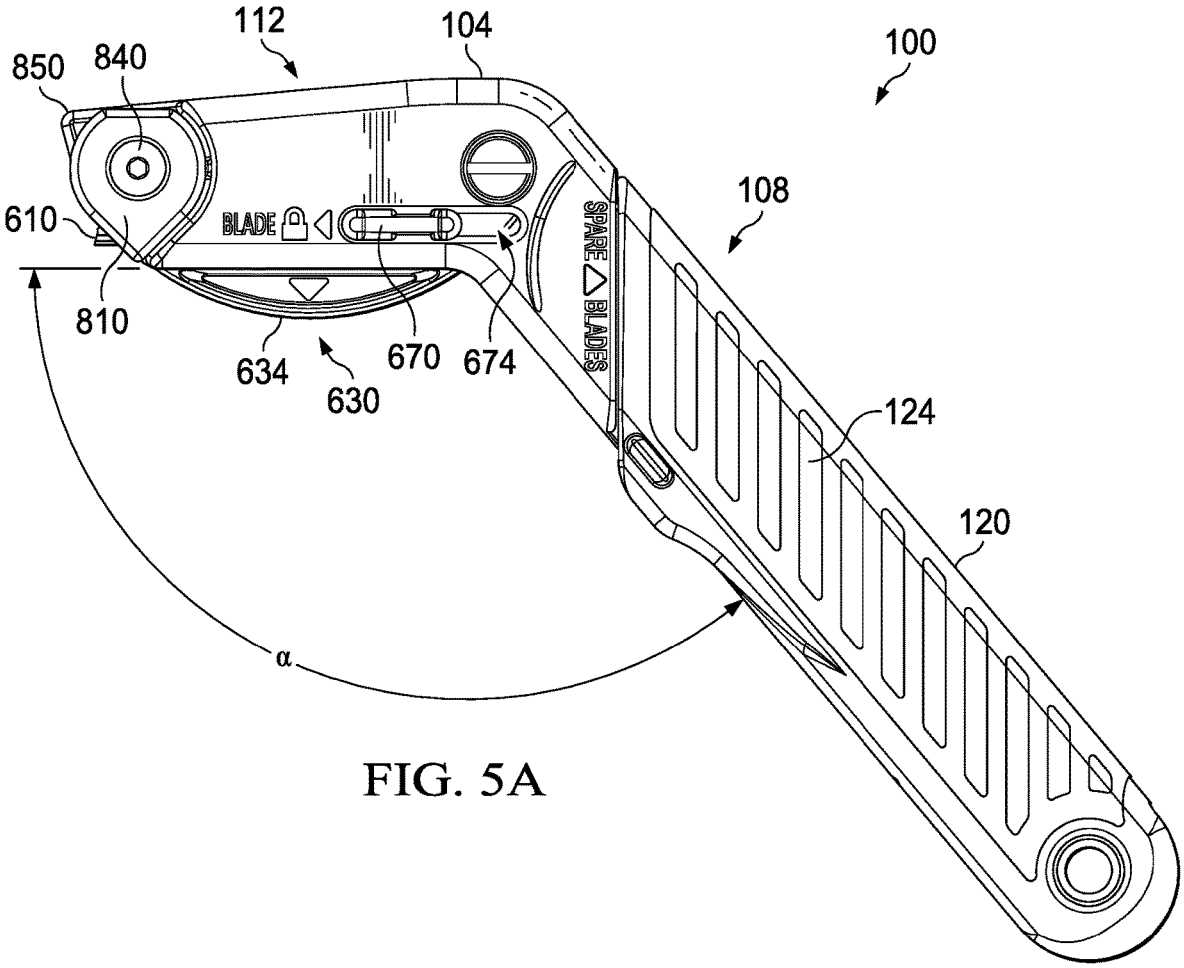
FIGS. 5A and 5B illustrate a right side view of the utility knife of FIG. 1, the utility knife having an active blade positioned in a scoring position in FIG. 5A and a cutting position in FIG. 5B.
Figure 5B:
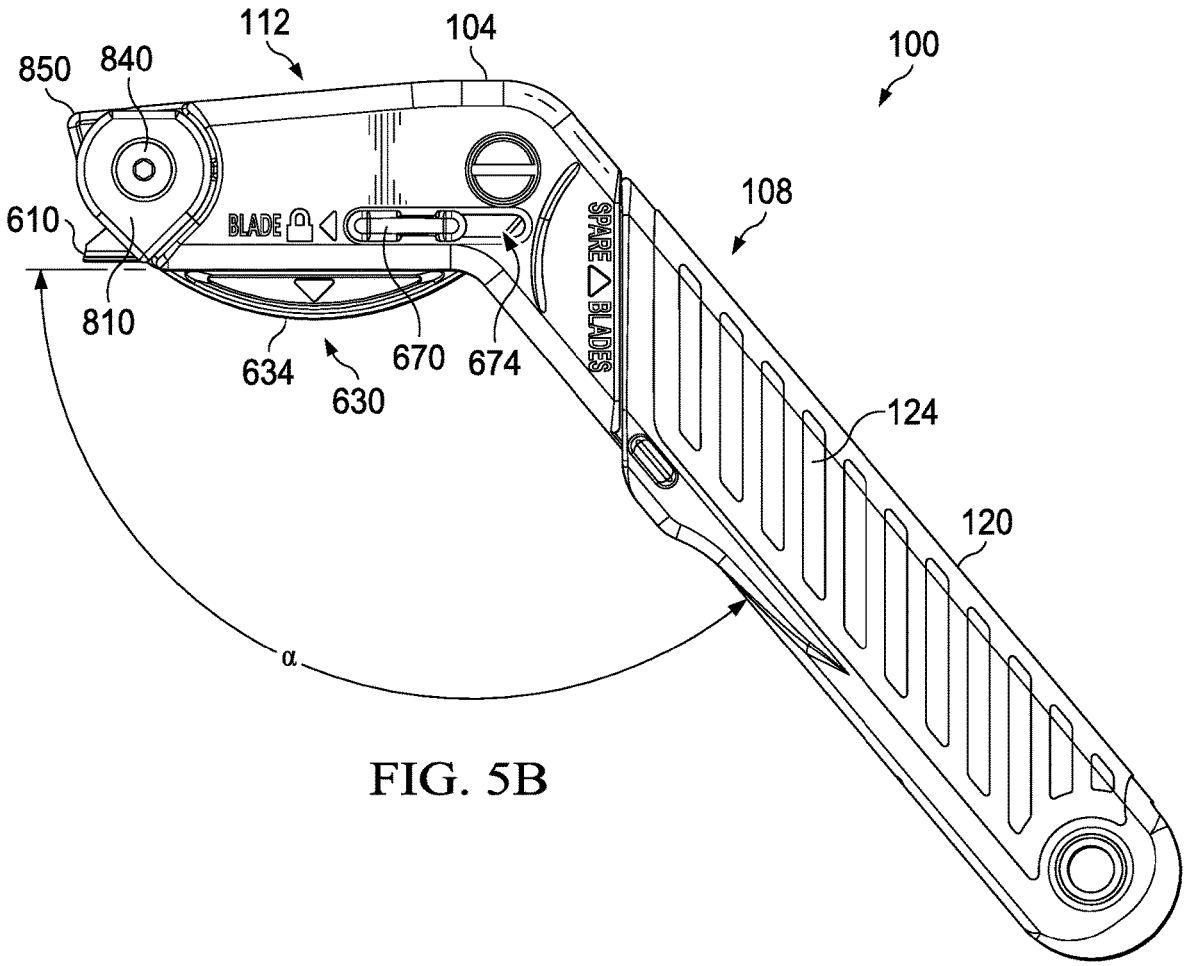

FIGS. 1 and 2 depict a utility knife 100 according to an illustrative embodiment that includes a body 104 having a handle portion 108 and a head portion 112. In the embodiment illustrated, the handle portion 108 and head portion 112 are integrally formed from a common material, but in other embodiments, the handle portion 108 and head portion 112 may be formed from different or the same material and coupled to one another. As illustrated in FIGS. 5A and 5B, an angle α between the handle portion 108 and head portion 112 may be greater than 90 degrees and less than 180 degrees in one embodiment. In other embodiments, the handle portion 108 and head portion 112 may have an angle α of 90 degrees or less, or the handle portion 108 and the head portion 112 may be substantially linear with angle α being 180 degrees. However, the angle α being greater than 90 degrees and less than 180 degrees is believed to improve the visibility of cuts or scores made into a working material (not shown) and also improve the leverage provided the user by the body 104. More preferably, the angle α may be between about 110 degrees and about 150 degrees. In the embodiment illustrated in FIGS. 5A and 5B, the angle α is about 130 degrees.

Figure 3:
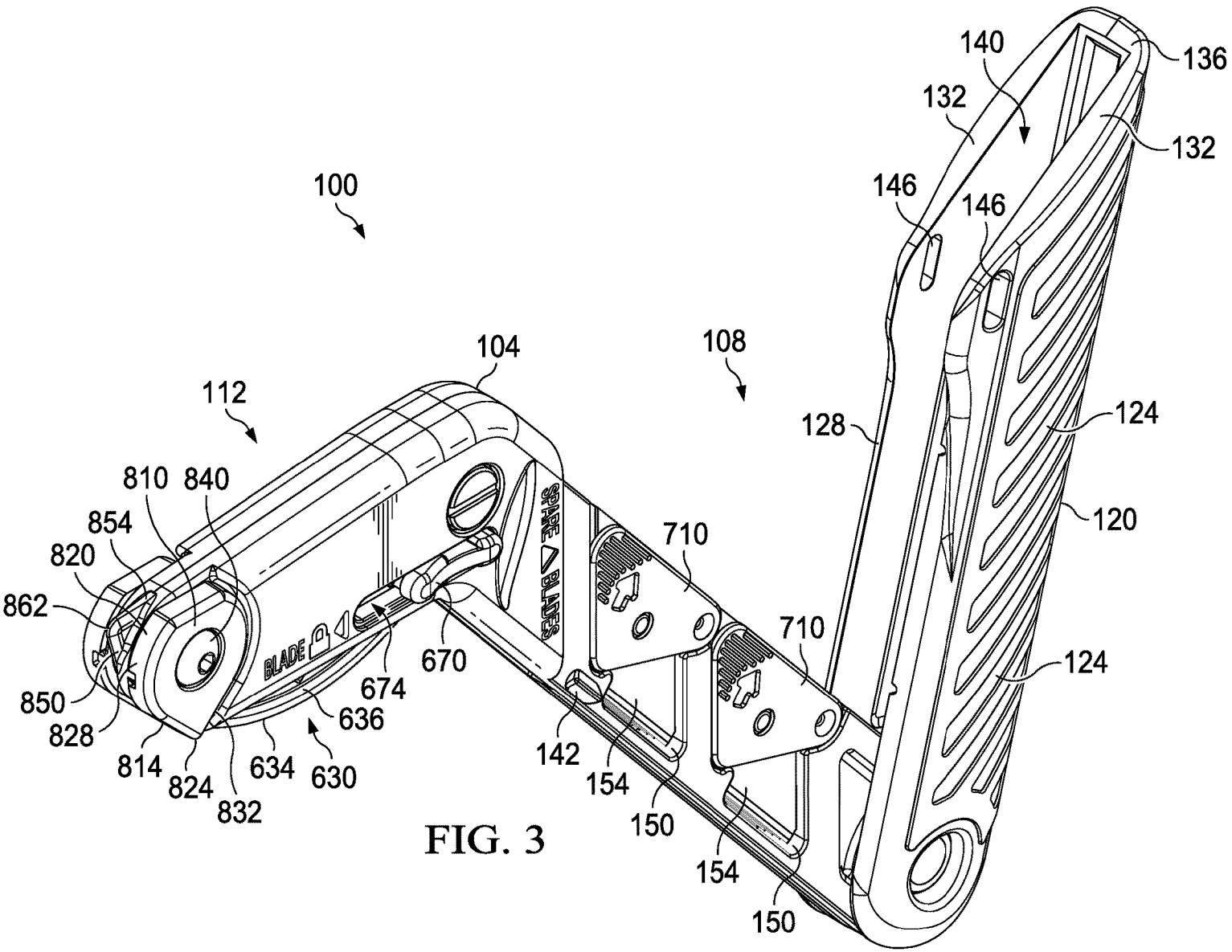
FIG. 3 illustrates an isometric right side and top view of the utility knife of FIG. 1, the utility knife having the grip in an open position, a keeper in a closed position, and a blade carrier in a closed position.

Referring still to FIGS. 1-2 but also to FIG. 3, the utility knife 100 includes a grip 120 that is pivotally coupled to the handle portion 108 of the body 104. In certain embodiments, the grip 120 is pivotally coupled by a pin, rivet or other fastener to an end of the handle portion 108 opposite the head portion 112. In other embodiments, the grip 120 could be coupled to the body 104 in other ways or could be coupled to the handle portion 108 adjacent the head portion 112. The grip 120 may be made from a polymer or an elastomeric material to improve the ability of a user to hold the utility knife 100. Indentations 124, or alternatively raised portions, may be disposed on the grip 120 to further improve a user's hold. The grip 120 is configured to be positioned in a closed position (see FIG. 1) and an open position (see FIG. 3). As shown in FIGS. 1 and 2, the grip 120 in the closed position covers the handle portion 108 of the body 104. In this closed position, the utility knife may be gripped by the user to perform cutting or scoring operations. As shown in FIG. 3, when the grip 120 is in the open position, the structure of the grip 120 is more apparent. The grip 120 includes a u-shaped elongated body 128 having a pair of side walls 132 arranged substantially parallel to one another and connected at one end to a wall 136. Together, the walls 132, 136 of the body 128 form a central channel 140 within which is received the handle portion 108 of the body 104. In the open position illustrated in FIG. 3, only the end of the handle portion 108 to which the grip 120 is pinned is received in the channel 140. With the grip 120 placed in the closed position, the channel 140 fully receives the handle portion 108. At least one of a detent 142 and a complimentary hole 146 is disposed on the grip 120, and another of the detent 142 and complimentary hole 146 is disposed on the body 104 of the utility knife 100. In the embodiment illustrated in FIG. 3, the hole 146 is positioned near an end of the grip 120 opposite the end pivotally attached to the body 104. More specifically, the hole 146 includes a pair of holes on ends of the walls 132 opposite the ends attached to wall 136. The holes 146 illustrated in FIG. 3 are elongated slots that extend through the walls 132 and are of similar shape to the detent 142 disposed on either side of the handle portion 108. When the grip 120 is moved into the closed position, the walls 132 may slightly deflect as each wall 132 passes over the detent 142 on the handle portion 108. When fully closed, the detents 142 are received fully by the holes 146 and the grip 120 is held in the closed position by the engagement of the detents 142 and holes 146. It should be apparent that the detent 142 or a similar protrusion may instead be included on the grip 120 and a complimentary hole 146 or recess disposed on the handle portion 108. The locking members (i.e., the detents and holes) may be included on both sides of the grip 120 as illustrated in FIG. 3 or only on one side. Similarly, it is important to note that while the grip 120 engages solely the handle portion 108 of the body 104, in certain embodiments, the grip 120 may be configured to extend further along the body 104 and engage the handle portion 108 and the head portion 112. In such an embodiment, the grip 120 may have locking members distributed on the grip 120 and the head portion 112.

Figure 4:
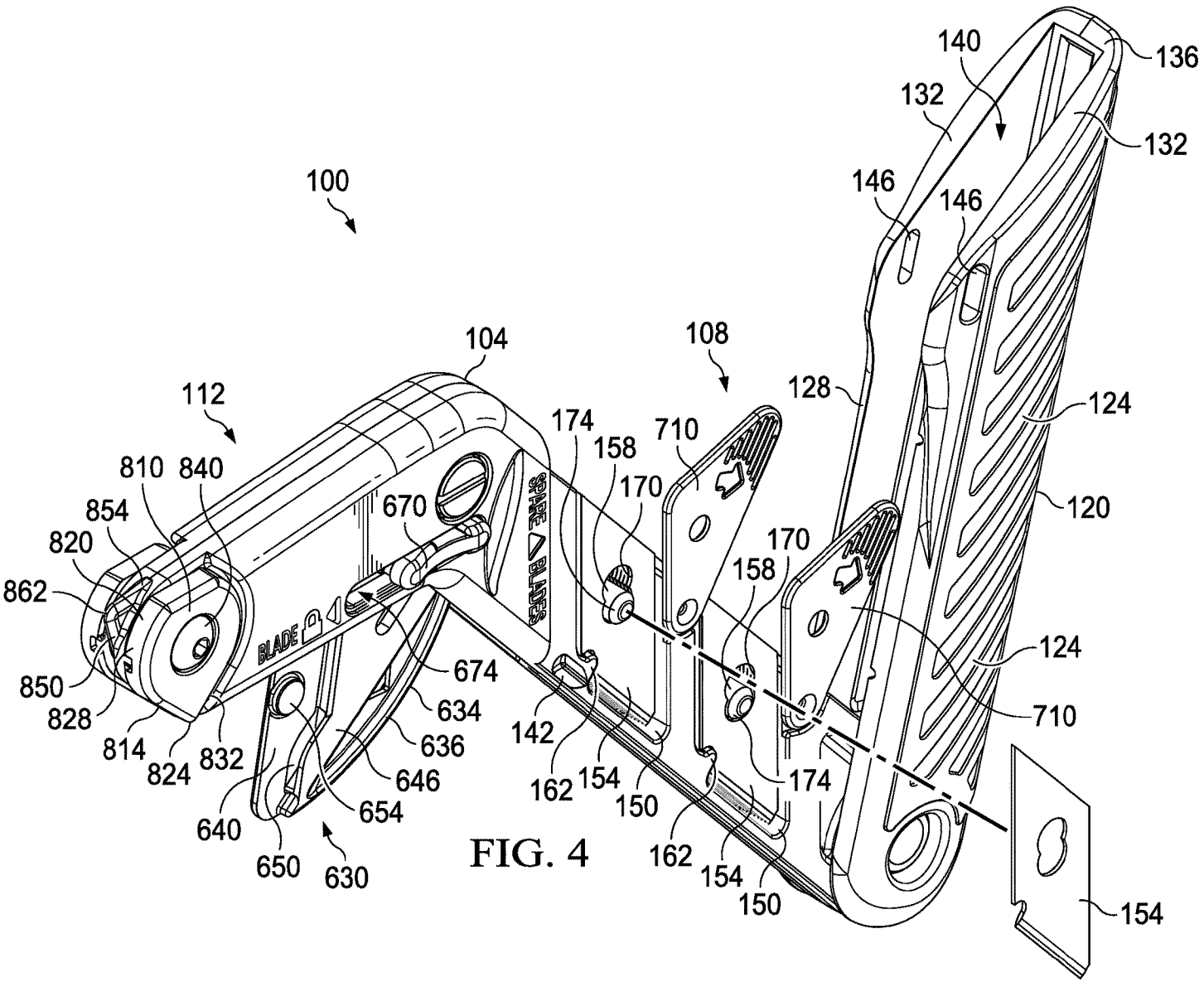
FIG. 4 illustrates an isometric right side and top view of the utility knife of FIG. 1, the utility knife having a handle in an open position, a keeper in an open position, and a blade holder in an open position.

Referring to FIGS. 3 and 4, the handle portion 108 of the body 104 includes a plurality of grooves or recesses 150 formed in the handle portion 108. Each of the recesses 150 is capable of receiving at least one replacement blade 154. In certain embodiments, the handle portion 108 may include a pair of recesses 150 as illustrated in FIGS. 3 and 4, but depending on the length of the handle portion 108, fewer or a greater number of recesses 150 may be provided. The recesses 150 may have any particular shape that is capable of accommodating the one or more replacement blades 154. In FIG. 3, the recesses 150 generally have a parallelogram-like shape and receive a similarly-shaped replacement blade 154. Referring more specifically to FIG. 4, each recess 150 may include a post 158 disposed in the recess 150. The post 158 may be welded or otherwise coupled to the handle portion 108 and extend from the handle portion 108 within at least a portion of the recess 150. Each recess 150 further may include a retainer tab 162 extending from the handle portion 108 of the body 104 near a corner of the recess 150. The retainer tab 162 extends toward the recess 150 such that the retainer tab 162 assists in securing the replacement blades 154 (shown in FIG. 3) as the replacement blades 154 are loaded into the recess 150. Each replacement blade 154 may include an opening 170, and the replacement blade 154 may be received in the recess 150 such that the post 158 extends through the opening 170 of the replacement blade 154. When multiple replacement blades 154 are held in each recess 150, the replacement blades 154 may be loaded into the recess 150 either individually or together in a stacked configuration such that the post 158 extends through all of the replacement blades 154. Further the post 158 may include a chamfered or tapered end 174 that may assist in loading replacement blades 154 on the post 158.

Figure 7A:
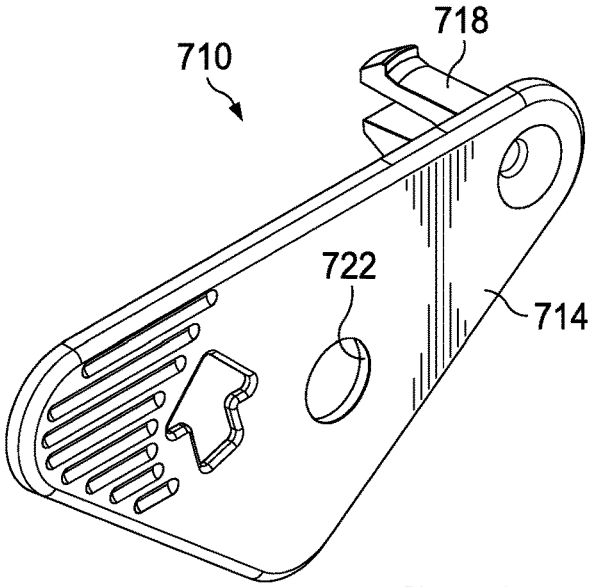
FIG. 7A illustrates an isometric right side view of a keeper according to an illustrative embodiment.

Referring still to FIGS. 3 and 4, but also to FIG. 7A, the utility knife 100 includes a keeper 710 that may be associated with each of the recesses 150 of the handle portion 108. The keeper 710 may include a substantially planar plate 714 in certain embodiments that is used to secure the replacement blades 154 within the recess 150. In some embodiments, the shape of the keeper 710 may be triangular. In other embodiments, the shape of the keeper 710 may vary, especially when the shapes of recess 150 or replacement blade 154 is different from those shown in FIGS. 3 and 4. The keeper 710 is pivotally coupled to the handle portion 108 of the body 104 and is rotatable between an open position and a closed position. In the closed position shown in FIG. 3, the keeper 710 covers the recess 150 to prevent the replacement blades 154 from inadvertently becoming dislodged from the recess 150. In the open position shown in FIG. 4, the keeper 710 is rotated away from the recess such that one or more of the replacement blades 154 may be removed from recess 150. Referring more specifically to FIG. 7, the keeper 710 may include a pin 718 or other coupling member extending from the plate 714. The pin 718 may be received by an aperture or slot (not shown) on the body 104 of the utility knife 100 to provide the pivotal connection. The keeper 710 may further include an aperture 722 positioned on the keeper 710 such that the aperture 722 aligns with the post 158 of the recess 150 when the keeper 710 is placed in the closed position. In some embodiments, the aperture 722 is circular and is centrally positioned in the plate 714. The aperture 722 is sized and shaped such the aperture 722 receives an end of the post 158 when the keeper 710 is in the closed position. When the end of the post 158 is chamfered or tapered as described previously, the size of the aperture 722 may be the same as the size of the post 158. Placing the keeper 710 into the closed position allows engagement between the chamfered or tapered end of the post 158 and the aperture 722. This engagement assists in securing the keeper 710 in the closed position and prevents inadvertent movement of the keeper 710 out of the closed position toward the open position.

Figure 6A:
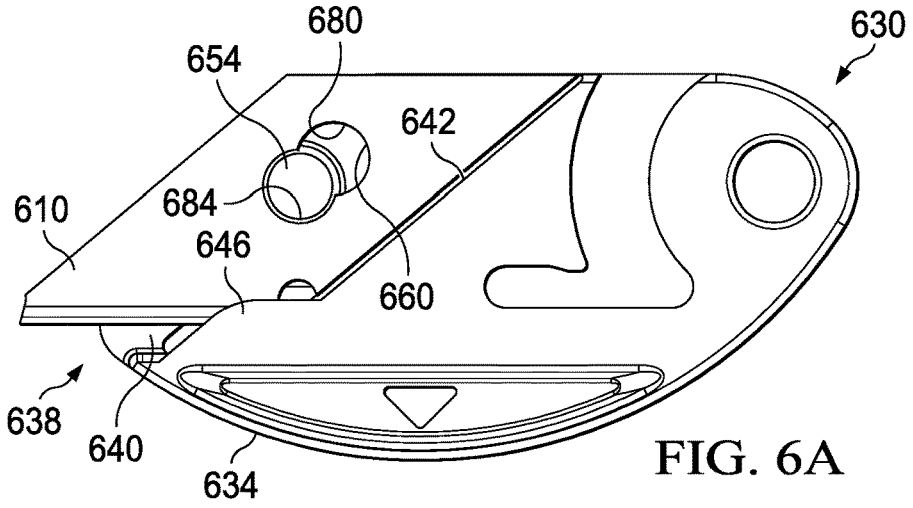
FIGS. 6A and 6B illustrate a right side view of a blade carrier and a blade according to an illustrative embodiment, the blade in FIG. 6A being positioned in a scoring position and the blade in FIG. 6B being positioned in a cutting position.
Figure 6B:
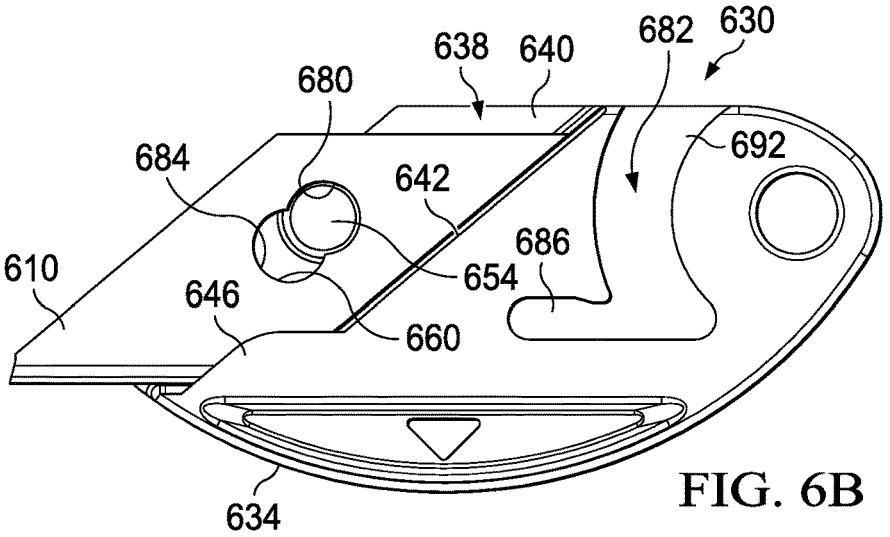

Referring again to FIGS. 3 and 4, but also to FIGS. 5A, 5B, 6A and 6B, the head portion 112 of the body 104 is the portion of the body 104 to which an active blade 610 may be coupled. The active blade 610 is the blade that has been loaded and provides the utility knife 100 with a cutting or scoring capability. A blade holder or blade carrier 630 is pivotally coupled to the head portion 112 of the body 104. The blade carrier 630 may be positioned in a closed position (see FIG. 3) and an open position (see FIG. 4). In the closed position, a portion of the blade carrier 630 is received by the head portion 112 such that the active blade 610 may be used for cutting or scoring operations. In the open position, the blade carrier 630 is moved away from the head portion 112 to expose the blade carrier 630 so that a blade may be loaded or replaced. The blade carrier 630 includes a handle 634 with a raised edge 636 that extends below the head portion 112 when the blade carrier 630 is in the closed position. The handle 634 allows the blade carrier 630 to be gripped by a user when it is desired to move the blade carrier 630 to the open position to load or replace the active blade 610. Referring more specifically to FIGS. 6A and 6B, the blade carrier 630 further includes a cradle region 638 to receive the active blade 610. The cradle region 638 has a surface 640 upon which the active blade 610 is received. The cradle region 638 further includes a shoulder 642 that may be shaped and positioned to engage an edge of the active blade 610, thereby further stabilizing the blade in the cradle region 638. In FIGS. 6A and 6B, the shoulder 642 is substantially planar (represented by an edge line in FIGS. 6A and 6B), and the shoulder 642 engages a trailing side edge of the active blade 610. The cradle region 638 further includes a catch 646 that may be offset from the surface 640 to create a slot 650 (see FIG. 4) between the surface 640 and the catch 646. A portion of the active blade 610 may be received by the slot 650, and the catch 646 assists in preventing the active blade 610 from moving away from the surface 640 while the active blade 610 is being loaded into the blade carrier 630 or when the blade carrier 630 is in the open position. The catch 646 may further stabilize the active blade 610 when the blade carrier 630 is in the closed position and the active blade 610 is used in a cutting or scoring operation. A fixed tab or post 654 is also disposed in the cradle region 638. The post 654 extends from the blade carrier 630 and is capable of being received by an opening 660 on the active blade 610. In one embodiment, the post 654 may extend from the surface 640 as illustrated in FIGS. 4, 6A and 6B. Like the surface 640, the shoulder 642, and the catch 646, the post 654 assists in retaining the active blade 610 and prevents movement of the active blade 610 during use. As is described in more detail herein, the post 654 may also assist in positioning the active blade 610 in multiple positions. In the embodiment illustrated in FIG. 6A, the positioning of the active blade 610 determines whether the active blade 610 may be used for scoring or cutting. In other embodiments, single-position blades may be used with the blade carrier 630, or a blade having an opening that allows for more than two positions may be used. The multiple positions of a blade may permit the depth of the cut to be determined, or may in some positions result in the blade being retracted or protected within the blade carrier 630 or head portion 112 of the body 104.

Figure 7B:
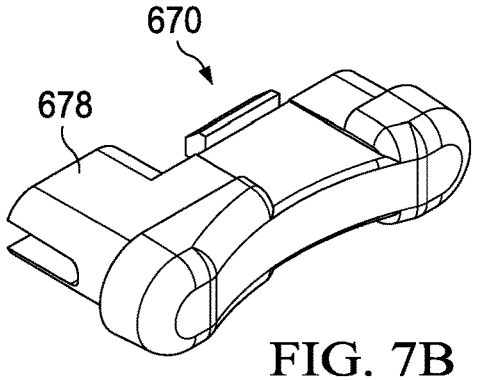
FIG. 7B illustrates an isometric right side view of a carrier lock according to an illustrative embodiment.

The utility knife 100 may include a lock button or carrier lock 670 operably associated with the head portion 112 of the body 104. The carrier lock 670 may in some embodiments be a push button, a rotating knob or any other type of lock that is capable of selectively preventing movement of the blade carrier 630. In the embodiment illustrated in FIGS. 1, 3, and 4, the carrier lock 670 is accessible on one side of the body 104 and is slidingly received by a slot 674 on the body 104. The carrier lock 670 is capable of sliding between a first position (see FIG. 1) to lock the blade carrier 630 in the closed position and a second position (see FIGS. 3 and 4) to allow the blade carrier 630 to be moved to the open position. Referring to FIG. 7B, the carrier lock 670 includes a tongue 678 or other protrusion on a surface of the carrier lock 670 that is oriented inward toward the body 104. The tongue 678 may be any particular shape that allows the carrier lock 670 to engage the blade carrier 630 to prevent the blade carrier 630 from moving out of the closed position when the carrier lock 670 is in the first position. When the carrier lock 670 is in the first position and the blade carrier 630 is closed, the tongue 678 is received in a groove 682 on the blade carrier 630. The groove 682 includes a lateral portion 686 and an arcuate portion 692. The arcuate portion 692 preferably has a center point that is the same as that about which the blade carrier 630 rotates. In the first position the tongue 678 is positioned in the lateral portion 686 of the groove 682. This prevents rotation of the blade carrier 630. When the carrier lock 670 is slidingly positioned in the second position, the tongue 678 is received by the arcuate portion 692 of the groove 682 such that the blade carrier 630 is capable of being rotated to the open position.

Referring to FIGS. 1-4, the utility knife 100 may include at least one exposure guide 810 removably coupled to the head portion 112 of the body 104. In certain embodiments, the at least one exposure guide 810 may include a pair of exposure guides 810, each coupled on opposing sides of the head portion 112 as shown in FIGS. 1 and 2. Each exposure guide 810 includes a substantially planar contact surface 814 which may be offset from the head portion 112 such that during use of the utility knife 100, the substantially planar contact surface 814 is capable of contacting a working material instead of the body 104 of the utility knife 100. In some embodiments, the exposure guide 810 may have a coefficient of friction that is less than a coefficient of friction associated with the head portion 112 of the body 104. Contact with the working material by the exposure guide 810 reduces the chance of marring or otherwise damaging a surface of the working material and also reduces the friction required to pull the utility knife 100 across the working material.

In some embodiments, the exposure guide 810 has a teardrop shape that includes a perimeter surface 820 that includes an apex portion 824, a rounded portion 828, and a pair of straight portions 832 between the apex portion 824 and the rounded portion 828. The straight portions 832 form the substantially planar contact surface 814 that comes in contact with the working material. The exposure guide 810 may be made from any material that is resilient and that preferably has a lower coefficient of friction than the material from which the body 104 is made. In one embodiment, the exposure guide 810 may be made from polytetrafluoroethylene. The exposure guide 810 on each side of the body 104 is preferably removable and replaceable when the exposure guide 810 becomes worn or damaged after excessive use. A screw 840 or other fastener couples the exposure guide 810 to the body 104, and the screw 840 may be removed to replace the exposure guide 810.

An alignment rib 850 may be disposed on the head portion 112 such that the alignment rib 850 extends from the head portion 112 of the body 104. The alignment rib 850 includes an alignment edge 854 aligned with a cutting edge of the active blade 610 to assist a user in guiding the utility knife 100 during cutting or scoring operations. Since the active blade 610 is beneath the body 104 when the utility knife 100 is used to score or cut, the placement of the alignment rib 850 on a side of the body 104 opposite the active blade 610 and near an end of the head portion 112 allows the user to view the alignment rib 850 and use the alignment edge 854 as a proxy for visualizing the active blade 610. The alignment rib 850 may be centrally located along a longitudinal plane bisecting the head portion 112 of the body 104. In some embodiments, the alignment rib 850 is triangular in shape with an apex 862 extending from the head portion 112 of the body 104.

Figure 8:
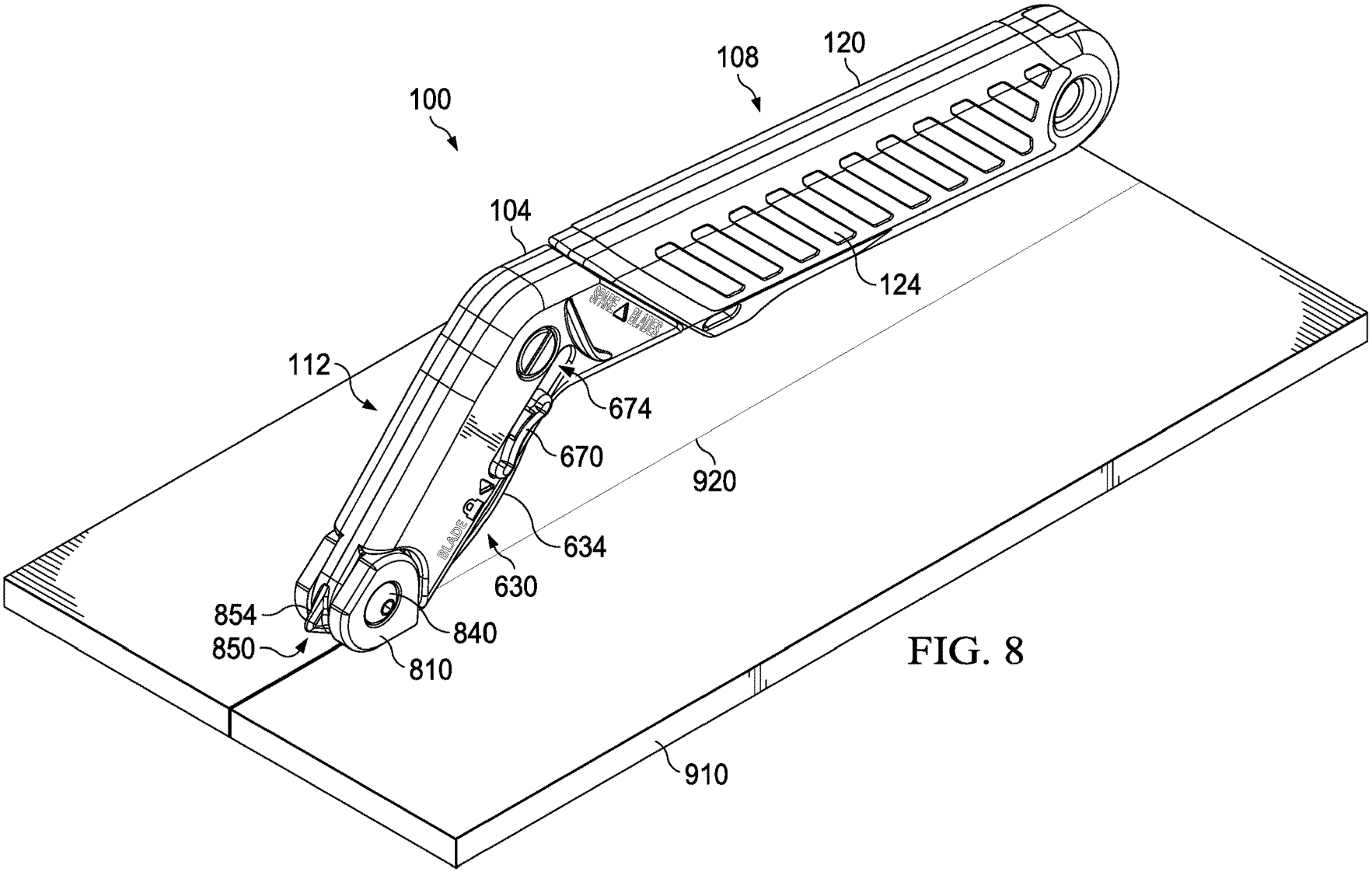
FIG. 8 illustrates an isometric right side and top view of a utility knife in operation being used to score or cut a working material according to an illustrative embodiment.
Figure 9:
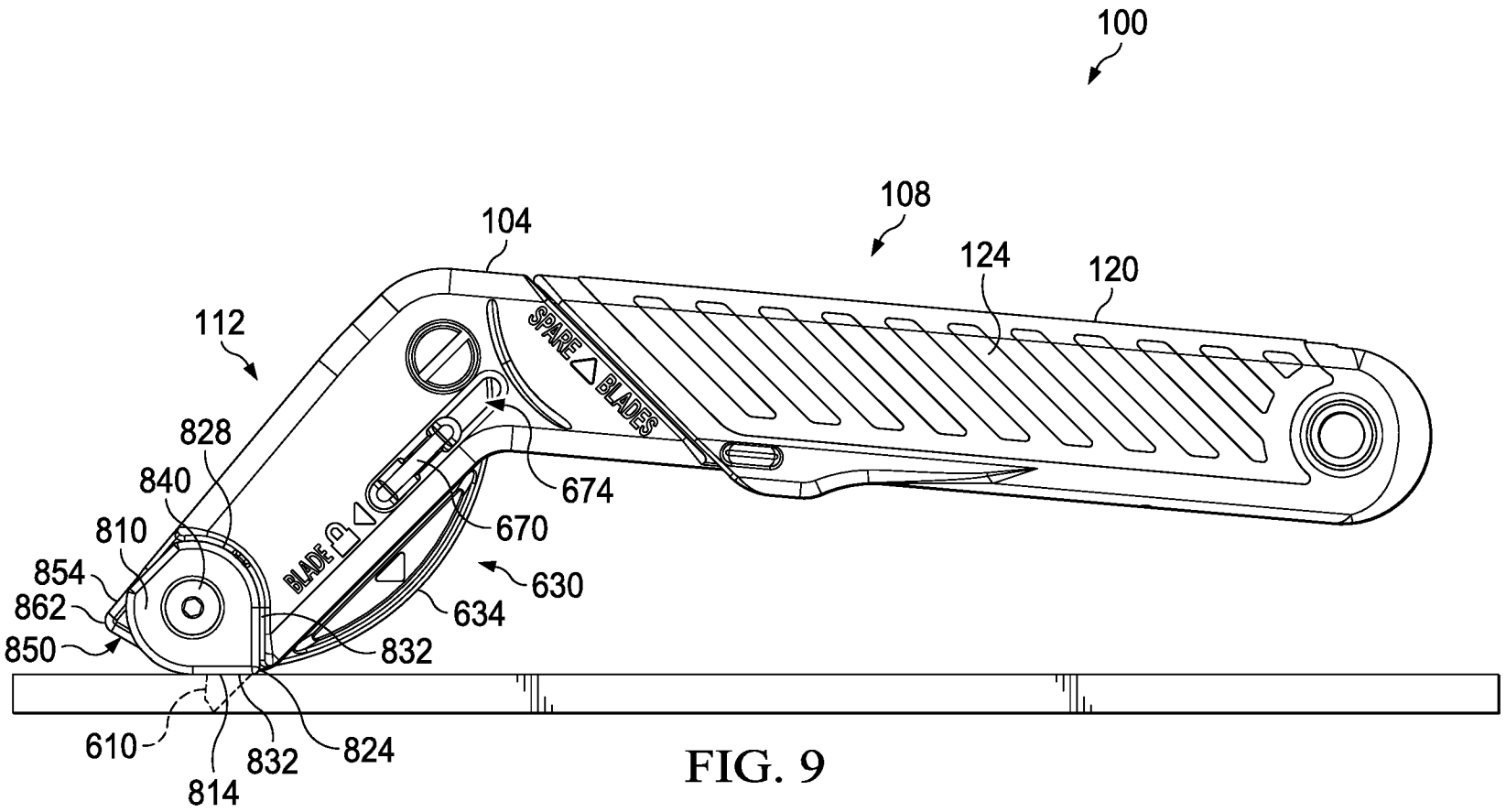
FIG. 9 illustrates a right side view of the utility knife of FIG. 8 in operation being used to score or cut the working material.

Referring to FIGS. 8 and 9, the utility knife 100 may be used to cut or score a working material 910. Whether the working material 910 is cut or scored depends on the thickness of the working material 910 and the position of the active blade 610. In some embodiments, the active blade 610 may be placed in a scoring position as shown in FIG. 5A or a cutting position as shown in FIG. 5B. In FIGS. 8 and 9, the use of the utility knife 100 during a cutting operation is shown. Prior to cutting the working material 910, the user may scribe a line 920 or other mark on the working material 910 with a pencil or other writing instrument, a chalk line, or a sharp-pointed object such as a nail. In other instances, the line 920 may be marked by a laser or other light-emitting device. The user places the utility knife 100 with the active blade 610 in contact with the working material 910. The utility knife 100 is generally positioned such that the handle portion 108 of the body 104 is parallel or near-parallel to the working material 910. More importantly, the utility knife 100 is oriented such that the substantially planar contact surfaces 814 of the exposure guides 810 are in contact with, and preferably flat against, the working material 910. Looking from above the utility knife 100, the user aligns the alignment edge 854 of the alignment rib 850 with the line 920. The user then places a downward force on the utility knife 100 and drags the utility knife 100 toward the user and across the working material 910. As the active blade 610 cuts the working material 910, the user must continue to keep the alignment edge 854 aligned with the line 920. A similar operation is used to score the working material 910, but the active blade 610 is first placed in the scoring position so that the depth of cut in the working material 910 is not as great.

When the active blade 610 is damaged or becomes dull, a user may wish to replace the active blade 610. To do so, the user may move the carrier lock 670 to the second position which unlocks the blade carrier 630. The user then grips the raised edge 636 of the handle 634 of the blade carrier 630 and pulls away from the head portion 112 of the body 104. The blade carrier 630 is rotated into the open position. In the open position, the user may remove the active blade 610 by lifting the active blade 610 from the post 654 and sliding the active blade 610 away from the cradle region 638 of the blade carrier 630. The active blade 610 is then disposed. The user then rotates the grip 120 into the open position exposing the keepers 710 and the recesses 150. The user grips one of the keepers 710 and disengages the aperture 722 of the keeper 710 from the post 158 and then rotates the keeper 710 into the open position. A replacement blade in the recess 150 that has been exposed is then lifted from the post 158 and the recess 150, and the replacement blade is placed in the blade carrier 630 in the same way that the now-disposed active blade 610 was held in the blade carrier 630. The blade carrier 630 is rotated back to the closed position, and the carrier lock 670 is moved to the first position to lock the blade carrier 630 in the closed position. Since there is no need for an additional replacement blade at this time, the keeper 710 may be rotated back to the closed position and the grip 120 back to the closed position.

As mentioned previously, and referring again to FIGS. 6A and 6B, in some embodiments the active blade 610 may include a multi-position opening such as opening 660. The opening 660 may include a first circular aperture 680 and a second circular aperture 684 positioned such that a portion of the first circular aperture 680 and a portion of the second circular aperture 684 overlap. The overlapping apertures result in the opening 660 assuming a figure-eight shape. The post 654 of the blade carrier 630 has a diameter approximately the same size as the apertures 680, 684, and the overlapping positioning of the apertures 680, 684 results in the post 654 being capable of being received in two different positions within the opening 660. In the scoring position (shown in FIG. 6A), the active blade 610 is raised slightly relative to the position of the active blade 610 in the cutting position (shown in FIG. 6B). The user may easily adjust the active blade 610 between the scoring position and the cutting position by simply opening the blade carrier 630 and lifting the active blade 610 off the post 654 to reposition the active blade 610 so that the post 654 falls within a different one of the apertures 680, 684.

Figures 10, 11:
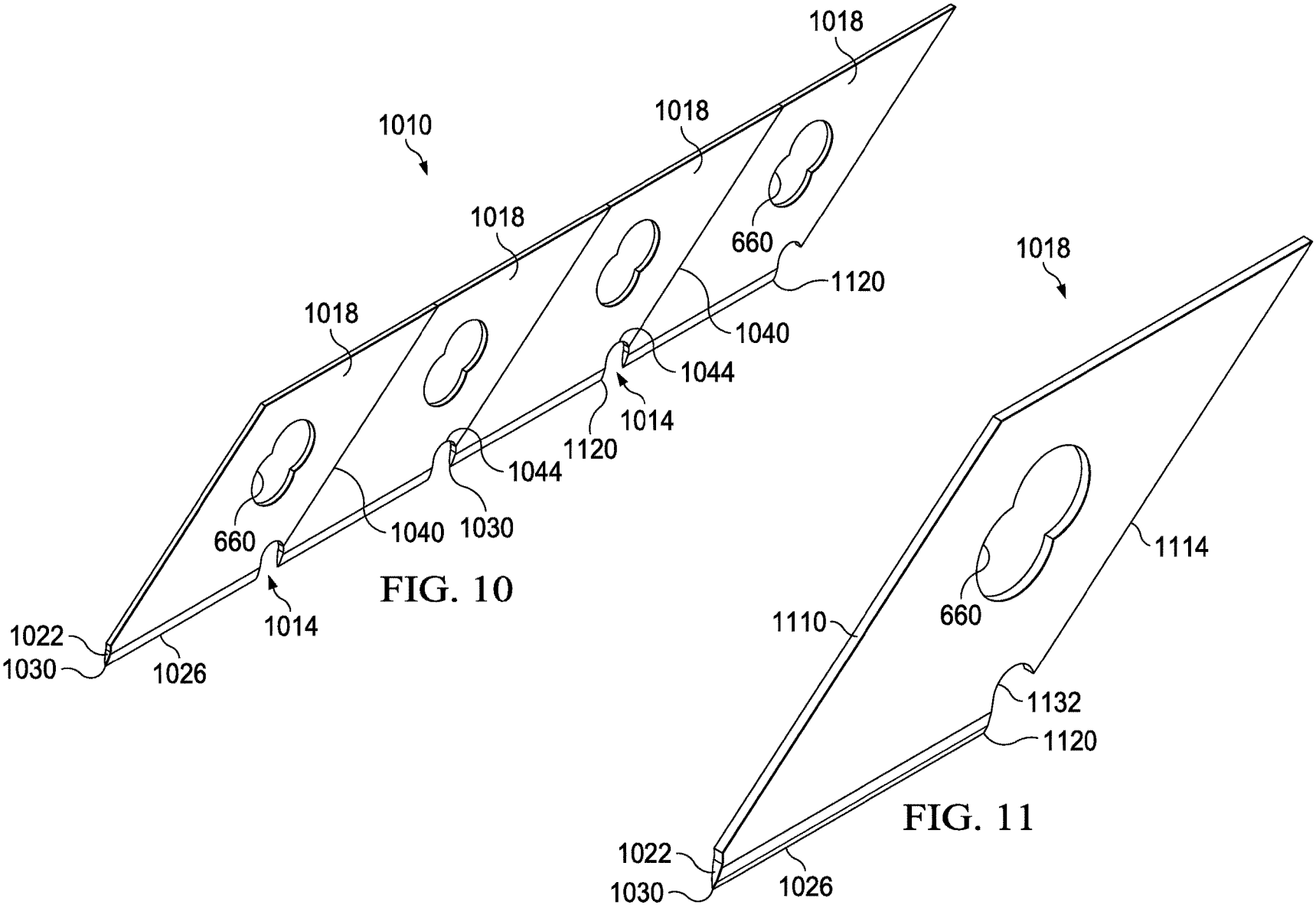
FIG. 10 illustrates an isometric right side view of a multi-blade strip having a plurality of coupled blades according to an illustrative embodiment.
FIG. 11 illustrates an isometric right side view of a blade according to an illustrative embodiment.

Referring to FIGS. 10 and 11, in some embodiments, the blades of the utility knives described herein may be sold as individual blades, either in single-blade packages, or multi-blade packages such that the multiple blades are stacked and configured for loading in the blade storage area of the knife. Even if the blades are provided to users as individual blades, it may be desired to manufacture the blades in a multi-blade strip 1010 (see FIG. 10) and then separate the blades prior to sale. In other embodiments, the blades may be provided to users in the multi-blade strip 1010 so that the user may separate the blades as needed. The multi-blade strip 1010 may include a notch 1014 between adjacent blades 1018 to aid in the separation of the blades 1018 from the multi-blade strip 1010. A front edge 1022 intersects a cutting edge 1026 of the blade 1018 such that a front tip 1030 of the blade 1018 is squared or nearly squared. This squared or nearly squared front tip 1030 improves the strength of the blade 1018 in this area. A score line 1040 is formed between adjacent blades 1018 where the thickness of the multi-blade strip 1010 has been reduced. The score line 1040 assists a user in breaking and thus removing a single blade 1018 from the strip. The score line 1040 is positioned such that the score line 1040 terminates at or near an apex 1044 of the notch 1014 away from the front tip 1030 of the blade. This positioning of the score line 1040 reduces the likelihood of the blade 1018 breaking in a manner that affects the front tip 1030 or the cutting edge 1026 of the blade 1018.

Referring to FIG. 11, when separated from the multi-blade strip 1010, each blade 1018 includes a leading side edge 1110 and a trailing side edge 1114. In the embodiment illustrated in FIGS. 10 and 11, a particular score line corresponds to both the leading side edge 1110 of one blade 1018 and the trailing side edge 1114 of an adjacent blade 1018. In other embodiments, a strip may be provided that has excess material between the trailing side edge 1114 and leading side edge 1110 of adjacent blades 1018. In some embodiments, the trailing side edges 1114 and leading side edges 1110 may be substantially parallel as shown in FIGS. 10 and 11, or may instead be non-parallel.

Referring still to FIG. 11, the cutting edge 1026 may be oriented in a non-parallel orientation relative to the leading side edge 1110 and the trailing side edge 1114 of an individual blade 1018. The cutting edge 1026 is offset a distance from the leading side edge 1110 such that the leading side edge 1110 does not intersect the cutting edge 1026 or contact the front tip 1030 of the blade 1018. Similarly, the cutting edge 1026 is offset a distance from the trailing side edge 1114 such that the trailing side edge 1114 does not intersect the cutting edge 1026 or contact a rear tip 1120 of the blade 1018. The front edge 1022 segments the leading side edge 1110 and the cutting edge 1026 to provide the required offset between the leading side edge 1110 and the cutting edge 1026. A rear edge 1132 segments the trailing side edge 1114 and the cutting edge 1026 to provide the required offset between the trailing side edge 1114 and the cutting edge 1026. The rear edge 1132 and the cutting edge 1026 intersect to form the rear tip 1120 of the blade. Together, the front edge 1022 and the rear edge 1132 may form the notch 1014 that is present when the blades 1018 are arranged together in the multi-blade strip 1010.

While the utility knives and blades described herein include many components and features that simplify and improve upon blade loading, blade adjustment, blade replacement, blade storage, cutting, scoring, alignment, safety, and other general use, it is not contemplated that the utility knife or the blades must include all of these components. Instead, the components may be used individually or in more discrete combinations with other components on more basic knives or utility knives that include a body and a blade. For example, recesses may be positioned in a handle of a knife to store replacement blades, and the knife in which the recesses are disposed may not include the rotational blade carrier described with reference to FIGS. 1-4. Instead, the knife may have a blade carrier that is slidingly movable relative to the body, or the blade may be affixed directly to the body of the knife without the need for a separate carrier. Similarly, some uses of the replacement blade recesses on other utility knives may not include keepers, or may not include a rotatable grip.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a utility knife comprising a body having a handle portion and a head portion, the handle portion having a recess capable of receiving at least one replacement blade; and a blade carrier pivotally coupled to the blade body and rotatable between an open position and a closed position.

Clause 2, the utility knife of clause 1 further comprising a grip pivotally coupled to the handle portion and configured to be positioned in an open position or a closed position, the grip in the open position providing access to the at least one replacement blade.

Clause 3, the utility knife of clause 1 or 2, wherein an angle between the handle portion and the head portion is greater than 90 degrees.

Clause 4, the utility knife of clause 2 or 3, wherein the grip has one of a detent and a recess; the body has another of the detent and recess; and the detent and the recess are configured to engage such that the grip is secured when placed in the closed position.

Clause 5, the utility knife of any of clauses 1-4, further comprising a carrier lock operably associated with the body and positionable in a first position to lock the blade carrier in the closed position and a second position to allow the blade carrier to be placed in the open position.

Clause 6, the utility knife of any of clauses 1-5, further comprising a carrier lock slidingly received by a slot on the body, the carrier lock having a tongue; wherein the carrier lock is slidingly positionable in a first position in which the tongue engages the blade carrier to prevent the blade carrier from moving out of the closed position; wherein the carrier lock is slidingly positionable in a second position in which the tongue is received by a groove on the blade carrier such that the blade carrier is capable of being rotated to the open position.

Clause 7, the utility knife of any of clauses 1-6, wherein the body further comprises an alignment rib extending from the head portion of the body, the alignment rib having an alignment edge aligned with a longitudinal bisecting axis of the body.

Clause 8, the utility knife of any of clauses 1-7, further comprising at least one exposure guide removably coupled to the head portion of the body, the at least one exposure guide having a substantially planar contact surface offset from the head portion, the substantially planar contact surface capable of contacting a working material during use of the utility knife to cut the working material.

Clause 9, the utility knife of clause 8, wherein the at least one exposure guide has a coefficient of friction that is less than a coefficient of friction associated with the head portion of the body.

Clause 10, the utility knife of any of clauses 1-9, further comprising a keeper pivotally coupled to the handle portion of the body and rotatable into an open position in which the at least one replacement blade may be removed from the recess or a closed position in which the keeper covers the recess.

Clause 11, a utility knife comprising a body having a handle portion and a head portion, the handle portion having a plurality of recesses formed in the handle portion, each of the recesses capable of receiving at least one replacement blade; a grip pivotally attached to the handle portion and configured to be positioned in an open position or a closed position, the grip in the open position providing access to the at least one replacement blade; a blade carrier pivotally coupled to the blade body, the blade carrier having a post, the blade carrier rotatable between a closed position in which the blade carrier is received by the head portion of the body and an open position in which the blade carrier has been rotated away from the head portion of the body; and an active blade received by the post of the blade carrier such that the post extends into an opening of the active blade, the active blade positioned in at least one of a cutting position and a scoring position.

Clause 12, the utility knife of clause 11, wherein the opening of the active blade is a multi-position aperture; and the positioning of the post in the aperture determines whether the active blade is positioned in the scoring position or the cutting position.

Clause 13, the utility knife of clause 11 or 12, wherein the active blade may be removed from the blade carrier when the blade carrier is positioned in the open position.

Clause 14, the utility knife of any of clause 11-13, wherein the body further comprises an alignment rib extending from the head portion of the body, the alignment rib having an alignment edge aligned with a cutting edge of the active blade.

Clause 15, the utility knife of any of clause 11-14, further comprising a carrier lock operably associated with the body and positionable in a first position to lock the blade carrier in the closed position and a second position to allow the blade carrier to be placed in the open position.

Clause 16, the utility knife of any of clause 11-15, further comprising a carrier lock slidingly received by a slot on the body, the carrier lock having a tongue; wherein the carrier lock is slidingly positionable in a first position in which the tongue engages the blade carrier to prevent the blade carrier from moving out of the closed position; wherein the carrier lock is slidingly positionable in a second position in which the tongue is received by a groove on the blade carrier such that the blade carrier is capable of being rotated to the open position.

Clause 17, the utility knife of any of clause 11-16, further comprising at least one exposure guide removably coupled to the head portion of the body, the at least one exposure guide having a substantially planar contact surface offset from the head portion, the substantially planar contact surface capable of contacting a working material during use of the utility knife to cut or score the working material.

Clause 18, the utility knife of clause 17, wherein the at least one exposure guide has a coefficient of friction that is less than a coefficient of friction associated with the head portion of the body.

Clause 19, the utility knife of any of clause 11-18 further comprising a keeper pivotally coupled to the handle portion of the body and rotatable into an open position in which the at least one replacement blade may be removed from one of the plurality of recesses or a closed position in which the keeper covers one of the plurality of recesses.

Clause 20, a method of replacing a blade in a utility knife, the method comprising unlocking a blade carrier; rotating the blade carrier from a closed position to an open position; removing an active blade from the blade carrier; placing a replacement blade in the blade carrier; returning the blade carrier to the closed position; and locking the blade carrier.

Clause 21, the method of clause 20, further comprising rotating a grip from a handle portion of the utility knife; and removing the replacement blade from a recess in the handle portion.

Clause 22, the method of clause 21, further comprising rotating a keeper into an open position to access the replacement blade in the recess.

Clause 23, the method of any of clause 20-22, wherein unlocking the blade carrier further comprises sliding a carrier lock from a first locked position to second unlocked position.

Clause 24, a utility knife comprising a body having a handle portion and a head portion; a blade coupled to the head portion; at least one exposure guide removably coupled to the head portion of the body such that during cutting or scoring use of the utility knife, the exposure guide is configured to contact a working material being cut or scored.

Clause 25, the utility knife of clause 24, wherein the body does not contact the working material during cutting or scoring use of the blade.

Clause 26, the utility knife of clause 24 or 25, wherein the at least one exposure guide has a coefficient of friction that is less than a coefficient of friction of the head portion of the body.

Clause 27, the utility knife of any of clause 24-26, wherein the at least one exposure guide has a substantially planar contact surface offset from the head portion.

Clause 28, the utility knife of clause 27, wherein the substantially planar contact surface is capable of contacting the working material.

Clause 29, the utility knife of any of clause 24-28, wherein the at least one exposure guide has a teardrop shape that includes a perimeter surface that includes an apex portion, a rounded portion, and a pair of straight portions between the apex portion and the rounded portion.

Clause 30, the utility knife of any of clause 24-29, wherein the at least one exposure guide comprises a pair of exposure guides, the pair of exposure guides coupled to the body on opposing sides of the body.

Clause 31, the utility knife of any of clause 24-30, wherein the at least one exposure guide is comprised at least partially of polytetrafluoroethylene.

Clause 32, a utility knife comprising a body having a handle portion and a head portion, the head portion and the handle portion forming an angle of greater than 90 degrees but less than 180 degrees; an active blade coupled to the head portion, the blade adjustable between a cutting position and a scoring position; at least one exposure guide removably coupled to the head portion of the body such that during cutting or scoring use of the utility knife, the exposure guide is configured to contact a working material being cut or scored.

Clause 33, the utility knife of clause 32, wherein the body does not contact the working material during cutting or scoring use of the blade.

Clause 34, the utility knife of clause 32 or 33, wherein the at least one exposure guide has a coefficient of friction that is less than a coefficient of friction of the head portion of the body.

Clause 35, the utility knife of any of clause 32-34, wherein the at least one exposure guide has a substantially planar contact surface offset from the head portion.

Clause 36, the utility knife of clause 35, wherein the substantially planar contact surface is capable of contacting the working material.

Clause 37, the utility knife of any of clause 32-36, wherein the at least one exposure guide has a teardrop shape that includes a perimeter surface that includes an apex portion, a rounded portion, and a pair of straight portions between the apex portion and the rounded portion.

Clause 38, the utility knife of any of clause 32-37, wherein the at least one exposure guide comprises a pair of exposure guides, the pair of exposure guides coupled to the body on opposing sides of the body.

Clause 39, the utility knife of any of clause 32-38, wherein the at least one exposure guide is comprised at least partially of polytetrafluoroethylene.

Clause 40, a method of scoring or cutting a working material, the method comprising providing a blade coupled to a body of a utility knife; aligning the blade with a desired cutting line associated with the working material; contacting a portion of an exposure guide with the working material; scoring or cutting the working material by moving the blade through the cutting material without contacting the working material with the body.

Clause 41, the method according to clause 40, wherein the exposure guide has a coefficient of friction less than a coefficient of friction of the body.

Clause 42, the method according to clause 40 or 41, wherein contacting the portion of the exposure guide with the working material further comprises contacting a substantially planar contact surface of the exposure guide with the working material.

Clause 43, a utility knife comprising a body having a recess capable of receiving at least one replacement blade; a grip pivotally coupled to the body and configured to be positioned in an open position or a closed position, the grip in the open position providing access to the at least one replacement blade; and a keeper pivotally coupled to the body and rotatable into an open position in which the at least one replacement blade may be removed from the recess or a closed position in which the keeper covers the recess.

Clause 44, the utility knife of clause 43 further comprising a post disposed in the recess; wherein the at least one replacement blade includes an opening and the at least one replacement blade is received in the recess such that the post extends through the opening.

Clause 45, the utility knife of clause 43 further comprising a post disposed in the recess; wherein the at least one replacement blade includes a plurality of replacement blades; wherein each of the plurality of replacement blades includes an opening and the plurality of replacement blades is received in the recess such that the post extends through the opening of each of the plurality of replacement blades.

Clause 46, the utility knife of clause 43 further comprising a post disposed in the recess; wherein the at least one replacement blade includes an opening and the at least one replacement blade is received in the recess such that the post extends through the opening; wherein the keeper includes an aperture that receives an end of the post when the keeper is in the closed position.

Clause 47, the utility knife of any of clause 43-46, wherein the end of the post is chamfered or tapered.

Clause 48, the utility knife of any of clause 43-47, wherein the keeper is triangular in shape.

Clause 49, the utility knife of any of clause 43-48 further comprising a second recess disposed in the body, the second recess capable of receiving at least one replacement blade; and a second keeper pivotally coupled to the body and rotatable into an open position in which the at least one replacement blade in the second recess may be removed from the second recess or a closed position in which the second keeper covers the second recess.

Clause 50, a utility knife comprising a body having a handle portion and a head portion, the head portion and the handle portion forming an angle of greater than 90 degrees but less than 180 degrees, the handle portion having a recess capable of receiving at least one replacement blade; a grip pivotally coupled to the handle portion and configured to be positioned in an open position or a closed position, the grip in the open position providing access to the at least one replacement blade; an active blade coupled to the head portion, the blade adjustable between a cutting position and a scoring position; a keeper pivotally coupled to the handle portion and rotatable into an open position in which the at least one replacement blade may be removed from the recess or a closed position in which the keeper covers the recess.

Clause 51, the utility knife of clause 50 further comprising a post disposed in the recess; wherein the at least one replacement blade includes an opening and the at least one replacement blade is received in the recess such that the post extends through the opening.

Clause 52, the utility knife of clause 50 further comprising a post disposed in the recess; wherein the at least one replacement blade includes a plurality of replacement blades; wherein each of the plurality of replacement blades includes an opening and the plurality of replacement blades is received in the recess such that the post extends through the opening of each of the plurality of blades.

Clause 53, the utility knife of clause 50 further comprising a post disposed in the recess; wherein the at least one replacement blade includes an opening and the at least one replacement blade is received in the recess such that the post extends through the opening; wherein the keeper includes an aperture that receives an end of the post when the keeper is in the closed position.

Clause 54, the utility knife of any of clause 50-53, wherein the end of the post is chamfered or tapered.

Clause 55, the utility knife of any of clause 50-54, wherein the keeper is triangular in shape.

Clause 56, the utility knife of any of clause 50-55 further comprising a second recess disposed in the handle portion, the second recess capable of receiving at least one replacement blade; a second keeper pivotally coupled to the handle portion and rotatable into an open position in which the at least one replacement blade in the second recess may be removed from the second recess or a closed position in which the second keeper covers the second recess.

Clause 57, a method of accessing a replacement blade of a utility knife, the method comprising rotating a grip of the utility knife relative to a body of the utility knife; rotating a keeper relative to the body to provide access to a recess in the body; and removing the replacement blade from the recess.

Clause 58, the method of clause 57, wherein the recess includes a post disposed in the recess, and removing the replacement blade from the recess further comprises removing the replacement blade from the post.

Clause 59, the method of clause 57 or 58, wherein the recess includes a post disposed in the recess, and rotating a keeper relative to the body further comprises disengaging an aperture of the keeper from an end of the post.

Clause 60, the method of clause 57, wherein the recess includes a post disposed in the recess; removing the replacement blade from the recess further comprises removing the replacement blade from the post; and rotating a keeper relative to the body further comprises disengaging an aperture of the keeper from an end of the post.

Clause 61, the method of any of clause 57-60, wherein removing the replacement blade from the recess further comprises removing the replacement blade from the post.

Clause 62, the method of any of clause 57-61, wherein rotating a grip of the utility knife relative to a body of the utility knife further comprises exposing the keeper and the recess.

Clause 63, a utility knife comprising a body having a handle portion and a head portion; and a blade coupled to the head portion, the head portion having an alignment rib extending from the head portion of the body, the alignment rib having an alignment edge aligned with a cutting edge of the blade.

Clause 64, the utility knife of clause 63, wherein the alignment rib is centrally located along a longitudinal plane bisecting the body.

Clause 65, the utility knife of clause 63 or 64, wherein the body further comprises a recess capable of receiving at least one replacement blade.

Clause 66, the utility knife of any of clause 63-65, wherein the body further comprises a recess capable of receiving at least one replacement blade; and a grip pivotally coupled to the body and configured to be positioned in an open position or a closed position, the grip in the open position providing access to the at least one replacement blade.

Clause 67, the utility knife of any of clause 63-66, wherein an angle between the head portion and the handle portion being greater than 90 degrees but less than 180 degrees.

Clause 68, the utility knife of any of clause 63-67 further comprising a recess capable of receiving at least one replacement blade; and a grip pivotally coupled to the body and configured to be positioned in an open position or a closed position, the grip in the open position providing access to the at least one replacement blade; wherein the alignment rib is centrally located along a longitudinal plane bisecting the body; wherein an angle between the head portion and the handle portion being greater than 90 degrees but less than 180 degrees.

Clause 69, the utility knife of any of clause 63-68, wherein the alignment rib is triangular in shape with an apex extending from the head portion of the body.

Clause 70, a utility knife comprising a body having a handle portion and a head portion, the head portion and the handle portion forming an angle of greater than 90 degrees but less than 180 degrees; and an active blade coupled to the head portion, the active blade adjustable between a cutting position and a scoring position; wherein the head portion includes an alignment rib extending from the head portion of the body, the alignment rib having an alignment edge aligned with a cutting edge of the active blade.

Clause 71, the utility knife of clause 70, wherein the alignment rib is centrally located along a longitudinal plane bisecting the head portion of the body.

Clause 72, the utility knife of clause 70 or 71, wherein the handle portion of the body further comprises a recess capable of receiving at least one replacement blade.

Clause 73, the utility knife of any of clause 70-72, wherein the body further comprises a recess disposed in the handle portion, the recess capable of receiving at least one replacement blade; and a grip pivotally coupled to the handle portion and configured to be positioned in an open position or a closed position, the grip in the open position providing access to the at least one replacement blade.

Clause 74, the utility knife of any of clause 70-73 further comprising a recess disposed in the handle portion, the recess capable of receiving at least one replacement blade; and a grip pivotally coupled to the handle portion and configured to be positioned in an open position or a closed position, the grip in the open position providing access to the at least one replacement blade; wherein the alignment rib is centrally located along a longitudinal plane bisecting the head portion.

Clause 75, the utility knife of any of clause 70-74, wherein the alignment rib is triangular in shape with an apex extending from the head portion of the body.

Clause 76, the utility knife of any of clause 70-75, wherein the alignment rib is positioned on an end of the head portion.

Clause 77, a method of scoring or cutting a working material, the method comprising providing a blade coupled to a body of a utility knife; aligning an alignment rib of the body with a desired cutting line associated with the working material; contacting a cutting edge of the blade with the working material; scoring or cutting the working material by moving the blade through the cutting material.

Clause 78, the method according to clause 77, wherein the alignment rib is triangular in shape with an apex extending from the head portion of the body.

Clause 79, the utility knife of clause 77 or 78, wherein the alignment rib is positioned on an end of the head portion.

Clause 80, a multi-blade strip comprising a plurality of separable blades each having a cutting edge; a notch formed between adjacent blades thereby creating a front tip on one of the adjacent blades; and a score line positioned between the adjacent blades such that the score line terminates at the notch away from the front tip.

Clause 81, the multi-blade strip of clause 80, wherein the score line is an area of reduced thickness of the multi-blade strip.

Clause 82, the multi-blade strip of clause 80 or 81, wherein the adjacent blades are separable along the score line without damaging the front tip.

Clause 83, the multi-blade strip of any of clause 80-82, wherein the notch has an arcuate shape.

Clause 84, the multi-blade strip of any of clause 80-83, wherein the notch creates a rear tip on another of the adjacent blades.

Clause 85, a utility knife blade comprising a leading side edge; a front edge adjacent the leading side edge; and a cutting edge adjacent the front edge, the cutting edge and the front edge intersecting to form a front tip; the cutting edge being offset a distance from the leading side edge such that the leading side edge does not intersect or contact the front tip.

Clause 86, the utility knife blade of clause 85, wherein the front edge segments the leading side edge and the cutting edge.

Clause 87, the utility knife blade of clause 85 or 86, wherein the leading side edge is oriented in a non-parallel orientation relative to the cutting edge.

Clause 88, the utility knife blade of any of clause 85-87, wherein the leading side edge is formed when the blade is separated along a score line from a multi-blade strip.

Clause 89, the utility knife blade of any of clause 85-88, wherein the distance between the cutting edge and leading side edge is measured along a line parallel to the cutting edge.

Clause 90, the utility knife blade of any of clause 85-89, further comprising a trailing side edge; a rear edge adjacent the trailing side edge; and wherein the cutting edge is adjacent the rear edge, the cutting edge and the rear edge intersecting to form a rear tip, the cutting edge being offset a distance from the trailing side edge such that the trailing side edge does not intersect or contact the rear tip.

Clause 91, the utility knife blade of clause 90, wherein the distance between the cutting edge and trailing edge is measured along a line parallel to the cutting edge.

Clause 92, the utility knife blade of clause 90 or 91, wherein the trailing side edge is substantially parallel to the front edge.

Clause 93, the utility knife blade of any of clause 90-92, wherein the trailing side edge is oriented in a non-parallel orientation relative to the cutting edge.

Clause 94, the utility knife blade of any of clause 90-93, wherein the trailing side edge is formed when the blade is separated along a score line from a multi-blade strip.

Clause 95, the utility knife blade of any of clause 85-94, wherein the front edge forms a portion of a notch in a multi-blade strip.

Clause 96, the utility knife blade of any of clause 85-95, wherein the rear edge forms a portion of a notch in a multi-blade strip.

Clause 97, a utility knife having a position-adjustable blade comprising a body; a blade carrier having a post extending from the blade carrier; and a blade having a multi-position opening received by the blade carrier such that the post extends into the multi-position opening, the blade positionable in a scoring position and a cutting position.

Clause 98, the utility knife of clause 97, wherein the positioning of the post in the opening determines whether the blade is positioned in the scoring position or the cutting position.

Clause 99, the utility knife of clause 97 or 98, wherein the blade carrier is pivotally coupled to the body and is movable between an open position and a closed position, the open position allowing the blade to be moved from one of the cutting position and the scoring position to another of the cutting position and the scoring position, the closed position securing the blade relative to the body.

Clause 100, the utility knife of any of clause 97-99, wherein the multi-position opening has a figure-eight shape.

Clause 101, the utility knife of any of clause 97-100, wherein the multi-position opening includes a first circular aperture and a second circular aperture positioned such that a portion of the first circular aperture and a portion of the second circular aperture overlap.

Clause 102, the utility knife of clause 101, wherein the post has a circular cross-section and fits within the first circular aperture when the blade is in the scoring position and the second circular aperture when the blade is in the cutting position.

The knife described herein may be used in any situation where cutting or scoring of a material is desired and may be particularly useful in cutting or scoring luxury vinyl tile (LVT) or other flooring or building materials.

What is claimed is:

1. A utility knife comprising:

a body having a handle portion, which is elongated, and a head portion, which is elongated, joined at a junction to define a non-zero angle between the handle portion and the head portion, the head portion extending from the junction to terminate at a free end, a first recess being defined in the head portion exposed along a first edge of the head portion;

a blade carrier pivotally coupled to the body and rotatable between an open position and a closed position, the blade carrier including a handle and an active blade receiving surface;

first and second exposure guides rigidly coupled in fixed positions on opposing sides of the head portion, the first and second exposure guides each having a substantially planar contact surface configured to contact a working material of the utility knife, wherein the contact surfaces define a portion of the free end of the head portion; and, an active blade mounted to the active blade receiving surface, the active blade having a cutting edge, wherein, in the open position, a majority of the blade carrier is external to the first recess with the active blade being accessible for removal of the active blade from the active blade receiving surface, and, wherein, in the closed position, the blade carrier is received within the first recess with: i. the handle protruding from the first edge of the head portion external to the head portion; ii. a first portion of the cutting edge of the active blade protruding from the contact surfaces of the first and second exposure guides; iii. a second portion of the cutting edge of the active blade, contiguous to the first portion, extending between the first and second exposure guides; and, iv. the cutting edge of the active blade being spaced from the first edge of the head portion in a direction away from the handle.

2. The utility knife of claim 1 further comprising a grip pivotally coupled to the handle portion and configured to be positioned in an open grip position or a closed grip position, the grip in the open grip position providing access to at least one replacement blade.

3. The utility knife of claim 2, wherein:

the grip has one of a detent and a recess;

the body has another of the detent and the recess; and the detent and the recess are configured to engage such that the grip is secured when placed in the closed grip position.

4. The utility knife of claim 1, wherein the angle between the handle portion and the head portion is greater than 90 degrees.

5. The utility knife of claim 1, further comprising a carrier lock operably associated with the body and positionable in a first position to lock the blade carrier in the closed position and a second position to allow the blade carrier to be placed in the open position.

6. The utility knife of claim 1, further comprising;

a carrier lock slidingly received by a slot on the body, the carrier lock having a tongue;

wherein the carrier lock is slidingly positionable in a first position in which the tongue engages the blade carrier to prevent the blade carrier from moving out of the closed position;

wherein the carrier lock is slidingly positionable in a second position in which the tongue is received by a groove on the blade carrier such that the blade carrier is capable of being rotated to the open position.

7. The utility knife of claim 1, wherein at least the first exposure guide has a coefficient of friction that is less than a coefficient of friction associated with the head portion.

8. The utility knife of claim 1, wherein the handle portion includes at least one recess capable of receiving at least one replacement blade, and further comprising a keeper pivotally coupled to the handle portion and rotatable into an open position in which the at least one replacement blade may be removed from the recess or a closed position in which the keeper covers the recess.

9. The utility knife of claim 1, wherein the blade carrier includes a post, and, the active blade includes an opening, and, wherein the active blade is mounted to the active blade receiving surface such that the post extends into the opening of the active blade.

10. The utility knife of claim 9, wherein:

the opening of the active blade is a multi-position aperture; and the positioning of the post in the multi-position aperture determines the extent to which the first portion of the cutting edge of the active blade protrudes from the contact surfaces with the blade carrier in the closed position.

11. The utility knife of claim 1, wherein the body further comprises an alignment rib extending from the head portion of the body, the alignment rib having an alignment edge aligned with the cutting edge of the active blade.

12. The utility knife of claim 1, wherein the first and second exposure guides are removably coupled to the head portion.

13. The utility knife of claim 1, wherein the contact surfaces subtend an acute angle with the first portion of the cutting edge so that one corner of the active blade protrudes from the contact surfaces.

* * * * *